United States Patent [19]

Connolly

[11] Patent Number: 4,868,937

[45] Date of Patent: Sep. 26, 1989

[54] THERAPEUTIC BED

[75] Inventor: Patrick J. Connolly, Westmeath, Ireland

[73] Assignee: Ethos Medical Research Limited, Limerick, Ireland

[21] Appl. No.: 130,371

[22] Filed: Dec. 8, 1987

[51] Int. Cl.[4] ..... A61G 7/00

[52] U.S. Cl. ..... 5/61; 5/60; 5/62; 177/144

[58] Field of Search ..... 5/60–65; 128/33; 177/144

[56] References Cited

U.S. PATENT DOCUMENTS

| | | | |
|---|---|---|---|
| 3,267,493 | 8/1966 | Pruim et al | 5/63 |
| 3,434,165 | 3/1969 | Keane | 5/61 |
| 3,848,278 | 11/1974 | Propst | 5/67 |
| 4,175,550 | 11/1979 | Leininger et al. | 5/61 |
| 4,638,516 | 1/1987 | Vrazlik | 5/62 |

FOREIGN PATENT DOCUMENTS

| | | | |
|---|---|---|---|
| 210469 | 4/1956 | Australia | 5/61 |
| 1566447 | 1/1970 | Fed. Rep. of Germany . | |
| 2445764 | 4/1976 | Fed. Rep. of Germany . | |

*Primary Examiner*—Alexander Grosz
*Attorney, Agent, or Firm*—Sughrue, Mion, Zinn, Macpeak and Seas

[57] ABSTRACT

A therapeutic bed comprises a patient support platform 2 rotatably and pivotally secured within a main bed frame 3 through pivot mountings 4, the main bed frame being supported on a base frame 5 by two spaced-apart end uprights formed by a pair of hydraulic rams 6. Each ram is individually height adjustable and one of the pairs of rams is pivotally connected to the base frame by a crankshaft 7 which in turn is pivotally connected by a pivot 8 to the base frame. The other pair of rams is pivotally connected to the base frame by a shaft 9. An electric motor 10 drives a belt 15 to rotate or oscillate the patient support platform. The arc of oscillation of the patient support platform is controlled by a control unit which includes a potentiometer. Weighing means for the patient support platform is provided by a laod cell mounted between each of the pivot mountings and the main bed frame.

12 Claims, 10 Drawing Sheets

THERAPEUTIC BED

BACKGROUND OF THE INVENTION

The present invention relates to hospital beds and more particularly to therapeutic beds.

Therapeutic beds are used for chronic patients such as paraplegics, patients that are partially or fully paralysed, patients suffering from head injuries or other serious injuries particularly spine injuries. These therapeutic beds are used to either render a patient incapable of voluntary movement or to in some way restrict some other movements. The problem with patients who are confined is that they suffer among other things from constipation, muscular wasting, bone decalcification and bed sores.

One of the best ways of overcoming this problem is a therapeutic hospital bed in which the patient supporting platform is mounted for controlled oscillation or controlled rotation within a bed frame relative to a bed support on which the bed frame is mounted. Generally speaking such a bed has lateral supports for a patient lying on the platform which are provided by upstanding side members detachably secured to the platform.

It has been found that in many cases the support platform must oscillate continuously but not to the full extent of its rotating arc on either side of a vertical axis. For example, where a patient has considerable injuries to one side it may be important that the bed does not oscillate to put too much weight onto that portion of the patient. There is thus a need to provide such a bed in which the arc of oscillation can be controlled.

A further problem arises with such beds in that because the patients are relatively immobile or almost totally immobile that the nurse or sick bay attendant has to perform every operation for the patient. In many treatments it is necessary to raise one or other end of the patient support platform or indeed, to raise the support platform horizontally.

Further, it has been found in practice that it is essential that the drive of the bed be disconnected at certain times. Indeed, this problem has been appreciated and various methods have been proposed for solving it.

Lastly, it has been found that the upstanding side members used to locate a patient often have to be moved and that there is need for an efficient way of disconnecting the lateral or upstanding side members.

SUMMARY OF THE INVENTION

The present invention is directed towards overcoming these problems and to providing a more efficient construction of such a therapeutic bed.

According to the invention there is provided a therapeutic bed comprising:

a base frame, a pair of uprights on the base frame, the uprights being spaced-apart and individually height adjustable, a crankshaft means, the crankshaft means being pivotally connected to the base frame for pivotal movement about a first pivot axis, at least one end upright being pivotally mounted to the crankshaft means for pivotal movement about a second pivot axis, the pivot axes of the crankshaft means being offset, a main bed frame, pivot mountings on the main bed frame, a patient support platform mounted on the pivot mountings, and a motor drive for oscillating the patient support platform relative to the main bed frame.

The term "crankshaft means" is used in this specification to cover a conventional crankshaft but also any linkage that allows a member to pivot about a pivot axis which pivot axis is offset from the mounting of the member relative to the pivot axis.

The major advantage of the mounting of the uprights in this manner is that it ensures that the bed remains in a stable condition at all times. Without this mounting arrangement movement of the bed across the floor can take place when a height adjustment is made to one or both of the end uprights. This could place further unnecessary stress on the patient.

Ideally one end upright is suspended from the base frame by the crankshaft means. This is a preferable way of mounting the upright as it is closest to the ground. It could however, be easily mounted at its upper end.

In a preferred embodiment of the invention the motor drive incorporates a drive connection, which is non-slip below a predetermined load, between it and the patient support platform and actuation means for engaging and disengaging the drive connection. The non-slip drive connection is preferably a belt. The belt drive obviates the necessity of incorporating a slip clutch to protect the motor as there is no solid linkage between the drive and the driven patient support platform and furthermore it makes it possible to engage/disengage the motor drive when the bed platform is in any position of rotation.

In a particularly suitable embodiment of the invention the motor drive includes:

an electric motor mounted on the main bed frame;

a drive train;

a gearbox connected to the output of the motor;

an output pulley driven by the electric motor through the gear box; and a drive train, the drive train comprising:

the output pulley;

an end board connected to the patient support platform;

an arcuate belt engaging track on the end board; and a drive belt secured adjacent both ends of the track and engaging the output pulley intermediate its ends.

This is a very simple drive which in the event of maintenance being required can be easily repaired and a drive belt can be replaced.

In another embodiment of the invention there is provided a weighing means for the patient support platform. A weighing means is particularly advantageous with the present construction of therapeutic bed.

Further, in accordance with the invention the weighing means is incorporated in the pivot mountings. This again is particularly advantageous in that by controlling and approaching as close as possible to the patient weight a more accurate measurement is achieved. This is preferable to weighing the whole bed where problems arise with what has been placed on the bed or removed from the bed since the last weighing. Further, continuous monitoring of the weight of a patient is often desirable if not essential.

In a further embodiment of the invention there is provided a method of controlling the rotation of the patient support platform of the therapeutic bed comprising the steps of:

sensing and recording the angular velocity of the patient support platform;

sensing and recording the angular velocity of the pulley;

comparing the recorded values to obtain a measured velocity difference;

comparing this measured velocity difference with an acceptable pre-set velocity difference value causing the motor to reverse its direction of rotation if the measured velocity difference is greater than the pre-set velocity difference value and return the patient support platform to a horizontal position.

BRIEF DESCRIPTION OF THE DRAWINGS

The invention will be more clearly understood from the following description of some embodiments thereof given by way of example only with reference to the accompanying drawings in which.

DETAILED DESCRIPTION OF THE PREFERRED EMBODIMENTS

Figure 1:
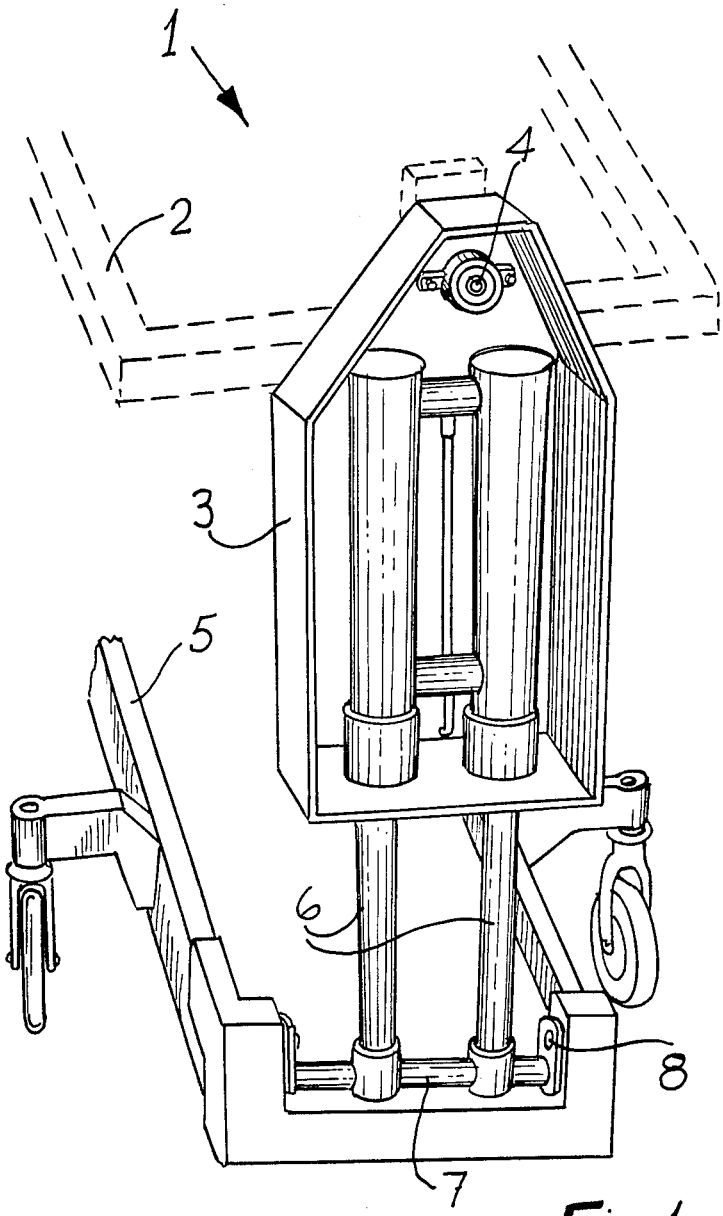
FIG. 1 is a perspective view of portion of the therapeutic bed according to the invention in the raised position.
Figure 2:
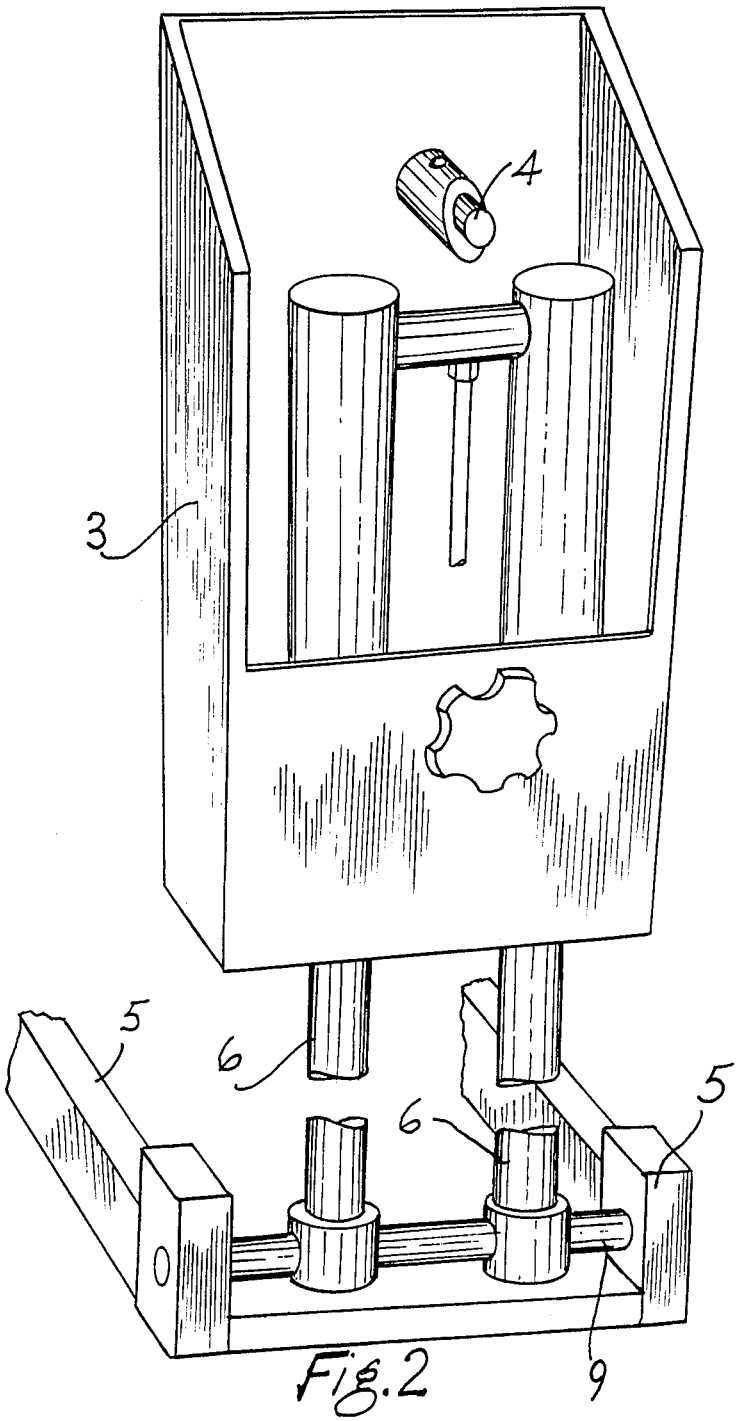
FIG. 2 is an end perspective view of portion of the other end of the therapeutic bed of FIG. 1.

It must be appreciated that only portions of the therapeutic hospital bed are illustrated in the drawings. For example, the mounting of a patient support platform within a main bed frame is not fully illustrated. The main bed frame may preferably be a U-shaped bed frame but is not fully illustrated. The purpose of these drawings is to merely show the modification of similar types of therapeutic beds and therefore, for clarity many details have been deliberately omitted as they add nothing to the understanding of the invention and would merely confuse the reader.

Referring to drawings and initially to FIGS. 1 to 4 thereof there is illustrated a therapeutic hospital bed indicated generally by the reference numeral 1 comprising a patient support platform 2 rotatably and pivotally secured within a main bed frame 3 on pivot mountings 4. The main bed frame 3 is supported on a base frame 5 by two spaced-apart end uprights formed by a pair of hydraulic rams 6. Each end upright is individually height adjustable and in this embodiment one of the pairs of hydraulic rams 6 is pivotally connected to the base frame 5 by a crankshaft 7 which in turn is pivotally connected by a pivot 8 to the base frame 5. In effect the crank shaft provides two offset pivot axes. The other pair of rams 6 is pivotally mounted on a shaft 9. Thus, when it is required to raise and lower one or both ends of the patient support platform 2 it may be readily easily done.

Figure 3:
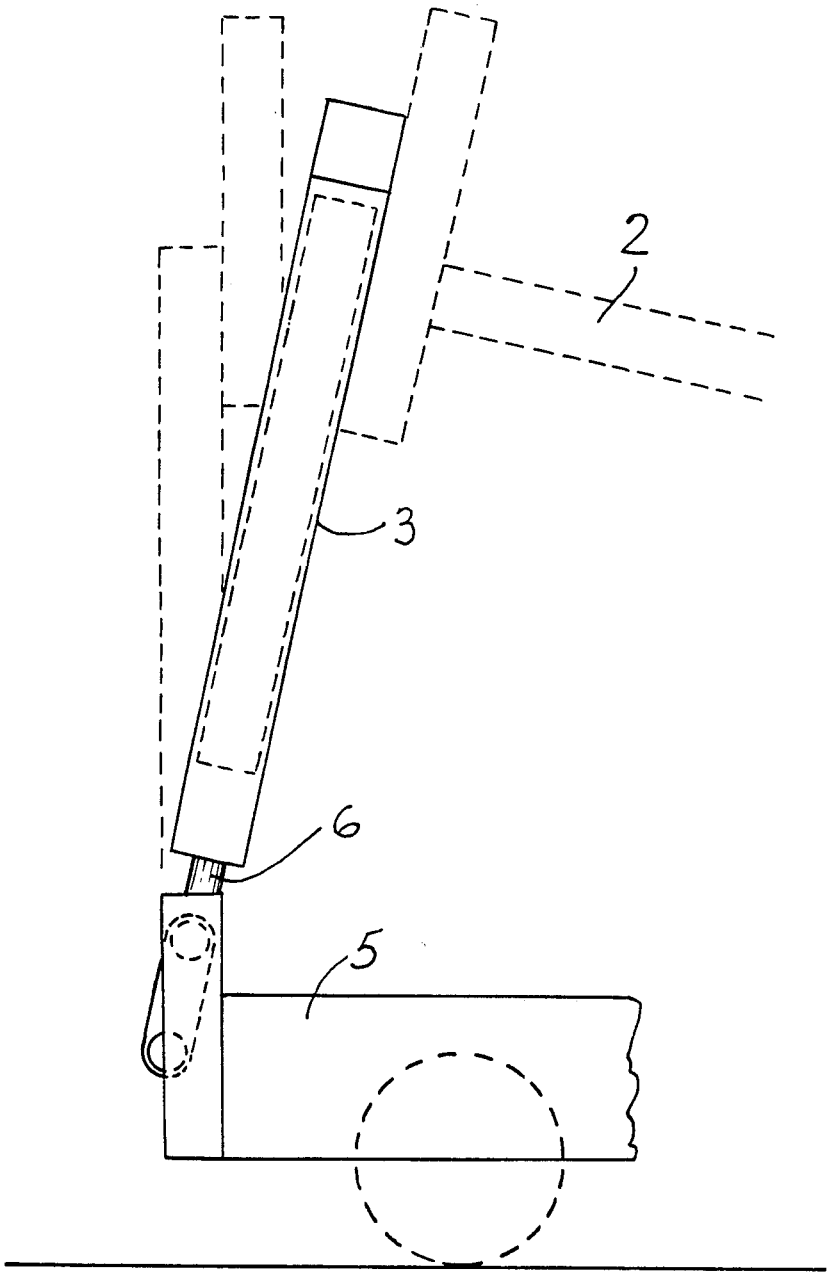
FIG. 3 is a side view of portion of the therapeutic bed in the raised position illustrated in FIG. 1.
Figure 4:
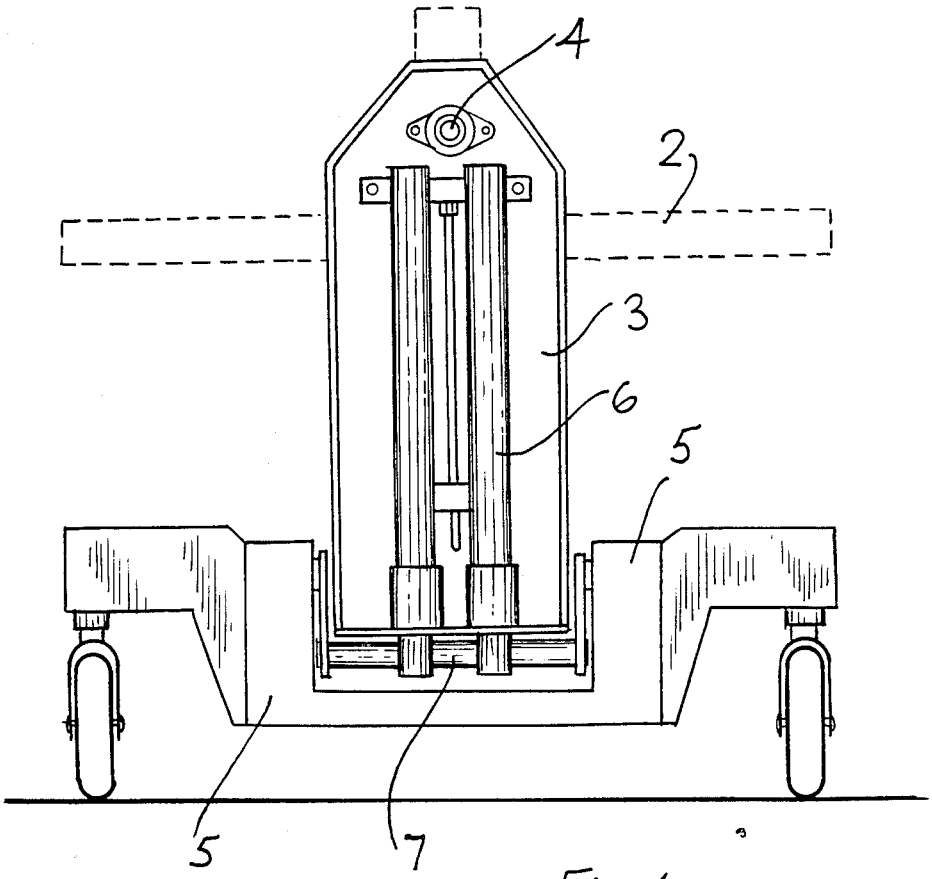
FIG. 4 is an end view of the portion of the therapeutic bed as illustrated in FIG. 1 in the lowered position.
Figure 5:
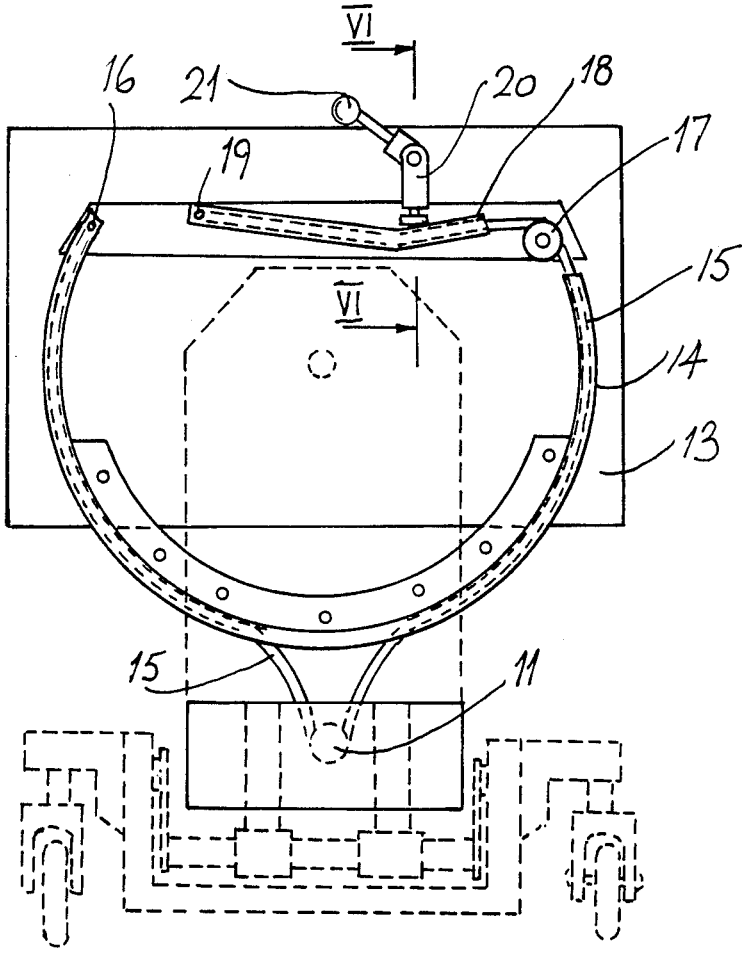
FIG. 5 is an end view of portion of a therapeutic bed according to the invention.
Figure 6:
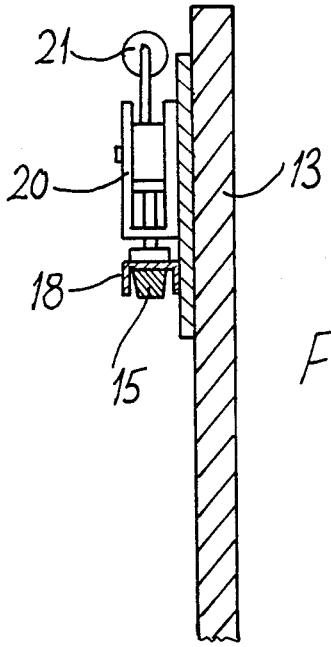
FIG. 6 is a part sectional view in the direction of the arrows VI—VI of FIG. 5.
Figure 8:
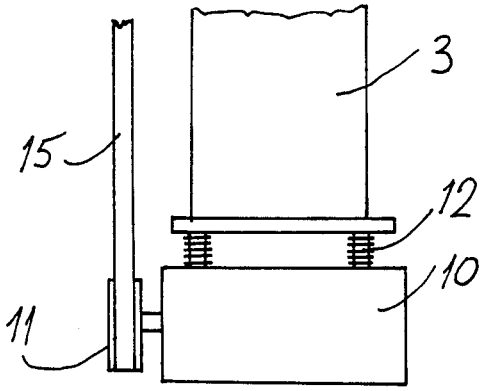
FIG. 8 is a side view of another portion of the therapeutic bed.
Figure 7:
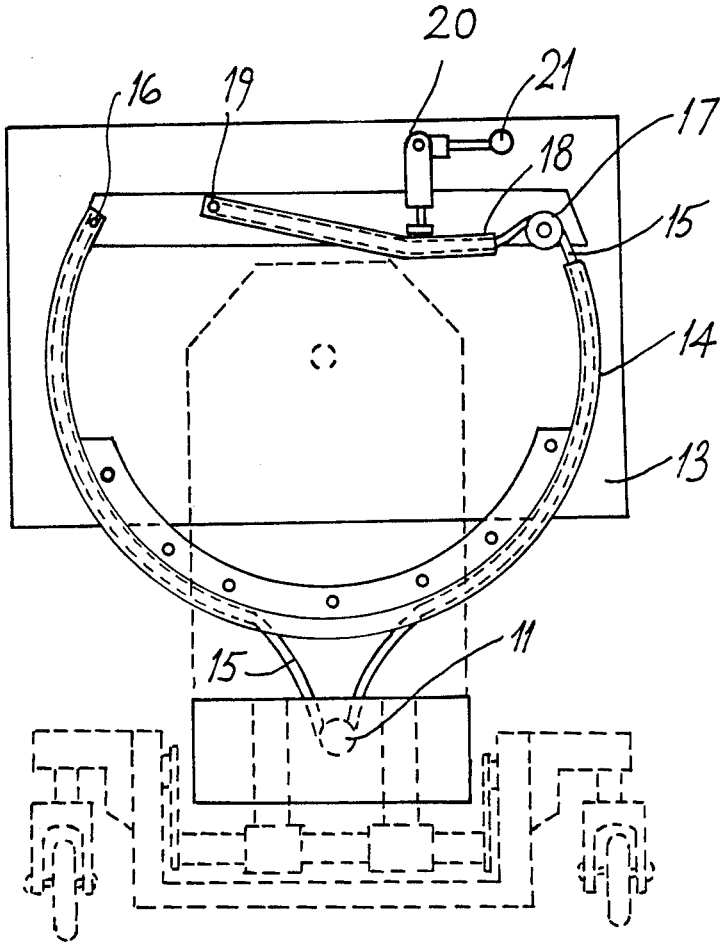
FIG. 7 is a view similar to FIG. 5 showing the therapeutic bed in a slightly different position.

For trendelenburg or reverse trendelenburg it will be seen quite clearly from FIG. 3 that any tilting of the bed in this operation does not effect the stability of the whole assembly.

Referring to FIGS. 5 to 8 there is illustrated portion of the motor drive which comprises a combined electric motor and gear box 10 having an output pulley 11. The combined motor and gearbox 10 is mounted by antivibration mountings 12 on the main bed frame 3. An end board 13 only illustrated in some of the FIGS. is mounted on the patient support platform 2 and has secured thereto an arcuate track 14. A drive belt 15, illustrated partly by interrupted lines is secured at one end 16 of the track 14 and is led over the output pulley 11 back onto the track 14 over a further pulley 17 into a guide 18 and is in turn secured rigidly therein. The guide 18 is pivotally mounted at 19 on the end board 13. Above the guide 14 is a camming lever 20 operable by a handle 21. Movement of the handle 21 from the position illustrated in FIG. 5 to the position illustrated in FIG. 7 will cause the belt 15 to engage firmly on the pulley 11. Thus, quick engagement and disengagement of the drive may be achieved. The belt 15 gives a strong and positive drive that will not slip under normal operating conditions.

The therapeutic bed 1 incorporates an electronic control system (not shown), of generally conventional construction, which senses and records the angular velocities of the patient support platform 2 and the pulley 11 and compares these values of angular velocity to obtain a measured velocity difference. This measured velocity difference is then compared with an acceptable pre-set velocity difference value, and if the measured velocity difference is greater than the pre-set velocity difference value a signal is sent to the motor 10 causing the motor 10 to reverse its direction of rotation and return the patient support platform 2 to the horizontal position.

Thus, in the event of an obstruction which prevents the patient support platform 2 from rotating the electronic control system detects a change in the relative angular velocity of the pulley 11 and the patient support platform 2 and signals the motor 10 to stop, reverse and return the patient support platform 2 to the horizontal position, simultaneously initiating audio and visual alarm signals.

In an effort to control the rotating arc of oscillation it has been found that continuous control is most important.

Figure 10:
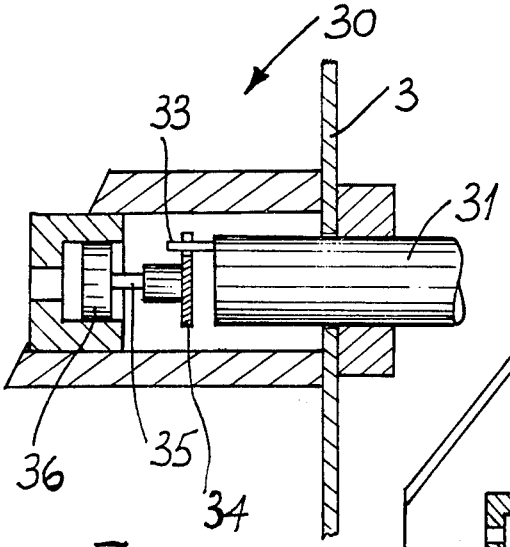
FIG. 10 is an enlarged sectional view of part of FIG. 9.
Figure 9:
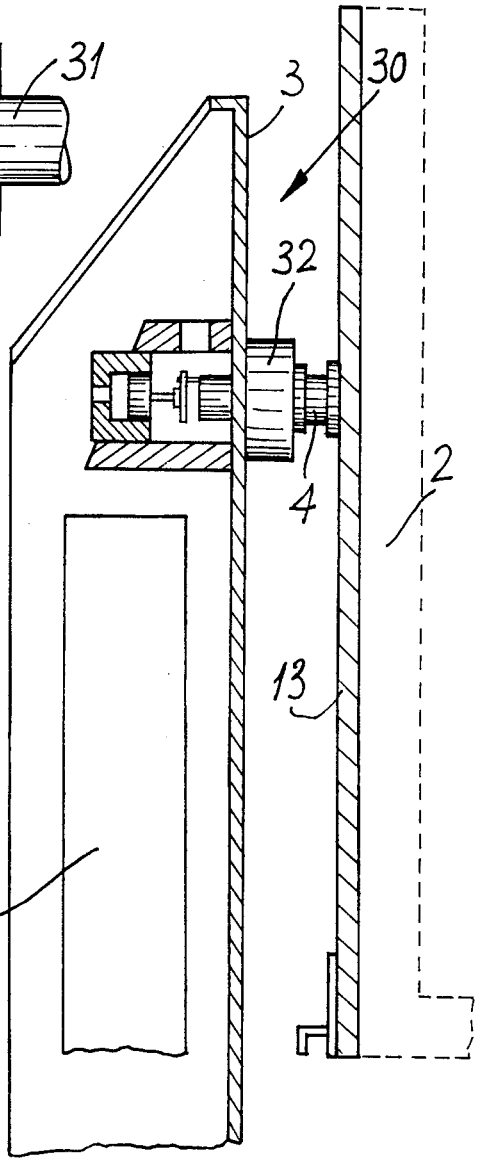
FIG. 9 is a side cross-sectional view of portion of the therapeutic bed.

Referring therefore, to FIGS. 9 and 10 there is illustrated a control unit indicated generally by the reference numeral 30 incorporated in the pivot mountings 4. Again only portion of the control unit is illustrated for clarity. The control unit 30 is mounted on a shaft 31 forming part of one of the pivot mountings 4 housed within a bearing 32 on the main bed frame 3. Projecting from the shaft 31 is a pin 33 engaging a slot in a disc 34 on a shaft 35 of a potentiometer 36.

In use, by varying the base voltage on the potentiometer 36 it is possible to vary the angle of rotation on either side by adding or subtracting from the base voltage. The potentiometer 36 is connected to the controls of the gearbox motor 10 so that when the correct voltage is reached the motor is stopped and reverses in direction. It is envisaged that conventional control equipment may be used to vary this base control voltage to the potentiometer not alone in absolute terms but also over time. Such control equipment is essentially conventional and it is not necessary to describe it. However, its use with a therapeutic bed according to the invention is particularly advantageous. Not alone is it advantageous in that by varying the arc of oscillation on either side of the vertical axis account is taken of possible injuries to a patient. The advantage of varying the arc of oscillation over time is that, particularly with nervous patients, it is possible to gradually increase the arc of oscillation without causing undue distress. Further, in certain cases it may be desirable to have a large arc of oscillation but due to the particular injuries or problems of the patient it may not be possible to do so. By this control method it is possible to vary the therapeutic effects of the bed. It is envisaged that a shaft position encoder could also be used.

Figure 11:
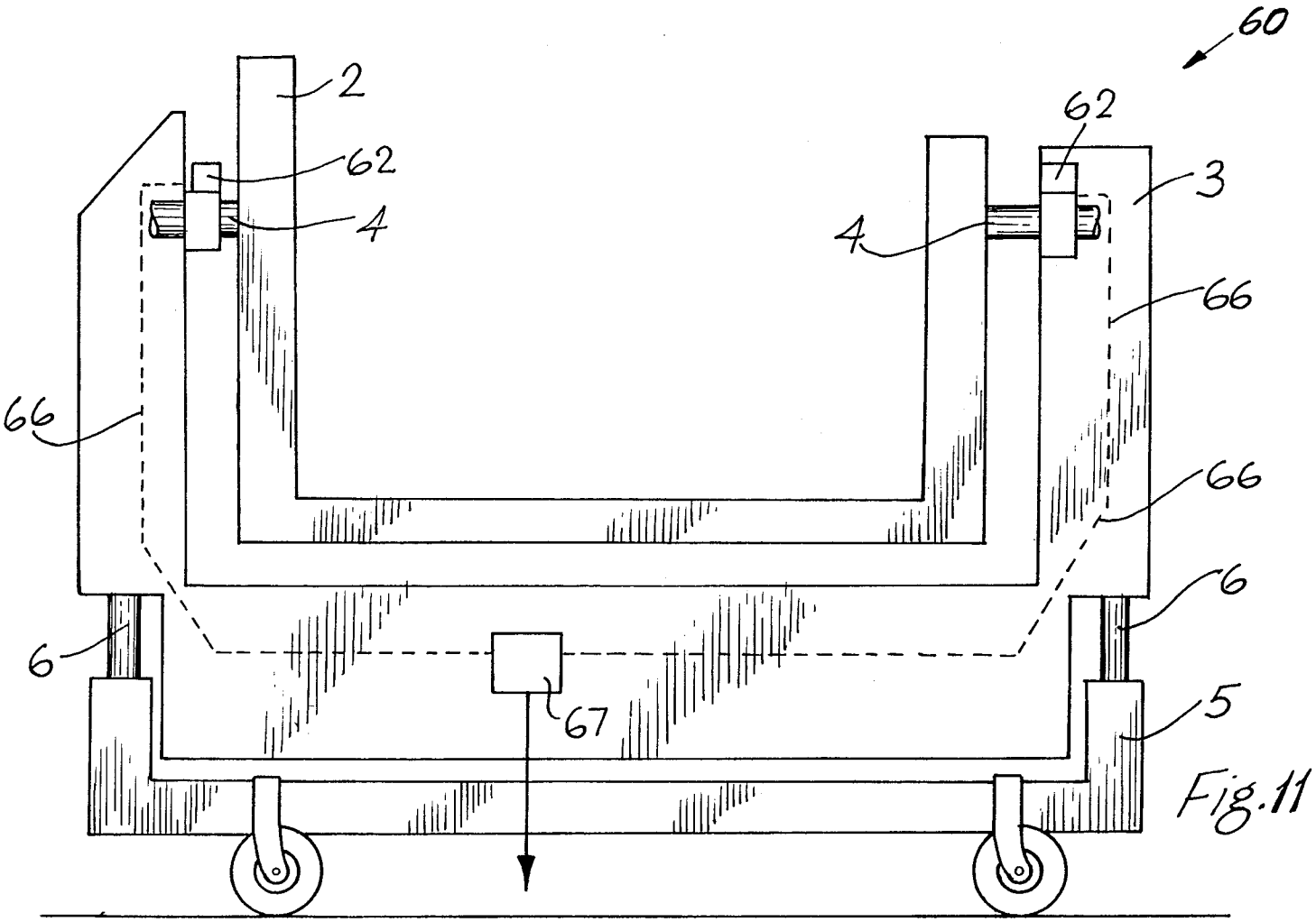
FIG. 11 is a side schematic view of an alternative construction of therapeutic bed according to the invention.
Figure 12:
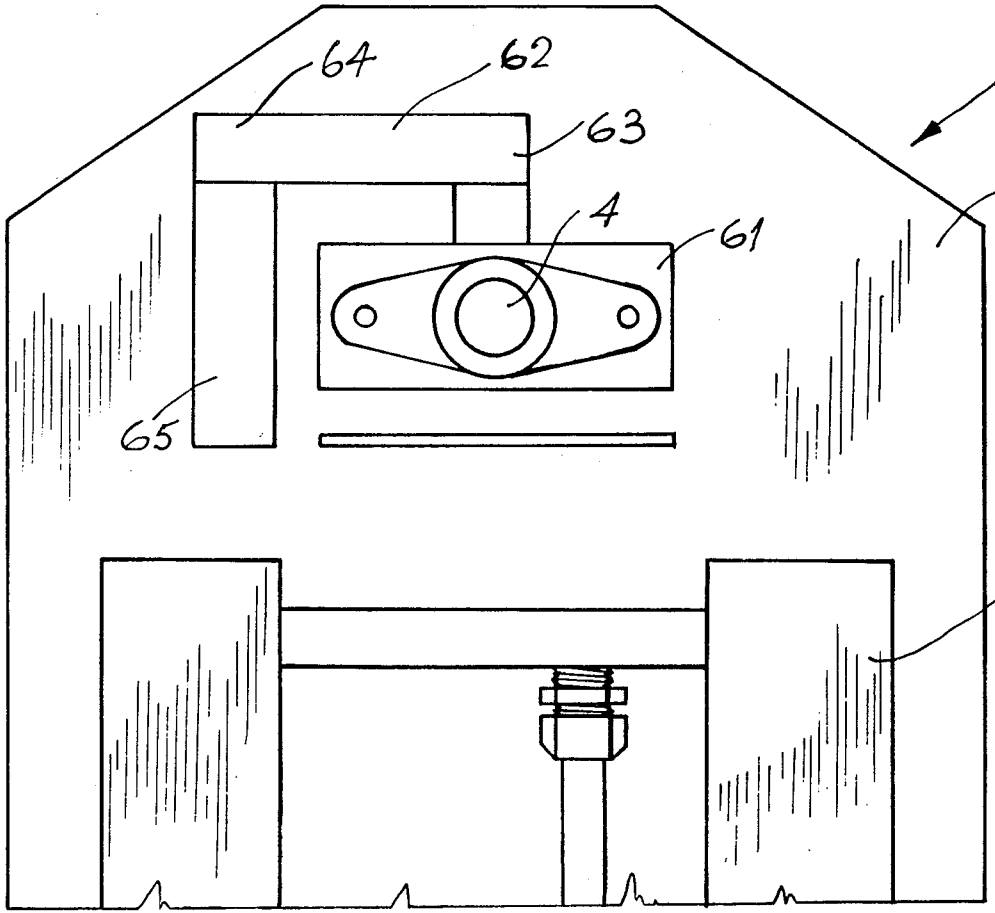
FIG. 12 is an end view of the therapeutic bed of FIG. 11.

Referring to FIGS. 11 and 12 there is illustrated in outline portion of an alternative construction of therapeutic bed according to the present invention indicated generally by the reference numeral 60 and parts similar to those described with reference to the previous drawings are identified by the same reference numerals and various parts of the bed are omitted. In this embodiment the patient support platform 2 is again mounted on the main bed frame 3 through the pivot mountings 4. However, the pivot mountings 4 are now mounted on a mounting block 61 which is suspended from or bearing on a cantilevered beam 62 which incorporates a load cell (not shown), the beam 62 having a free end 63 and a fixed end 64. The free end 63 of the beam 62 is secured to the mounting block 61 and the fixed end 64 of the beam 62 is rigidly attached to the main bed frame 3 by a bracket 65. The load cell feeds in conventional manner through cabling 66 a junction box 67 and in conventional manner a suitable indicator or readout.

It will be appreciated that the placing of the load cell as close as possible to the patient support platform 2 will greatly facilitate accurate weighing. Indeed, by the use of suitable controls the weight of a patient can be continuously monitored. In certain circumstances even minute variations in weight are of considerable significance.

I claim:

1. A therapeutic bed, comprising:

(a) a generally horizontal, elongate base frame (5), (b) a pair of end uprights (6) individually upstanding from opposite ends of the base frame, said uprights being individually height adjustable, (c) crankshaft means pivotally connected to one end of the base frame for pivotal movement about a first pivot axis (8), (d) at least one of said uprights being pivotally mounted to the crankshaft means for pivotal movement about a second pivot axis (7) laterally offset from said first pivot axis, (e) a pair of main bed frames (3) individually mounted to said pair of uprights at opposite ends of the base frame, (f) a generally horizontal, elongate patient support platform (2) pivotally mounted (4) at opposite ends thereof to and between said main bed frames, and (g) motor drive means operatively coupled to said patient support platform for oscillating said platform relative to the main bed frame.

2. A therapeutic bed as recited in claim 1 wherein said at least one end upright is suspended downwardly from the first pivot axis by said crankshaft means.

3. A therapeutic bed as recited in claim 1 wherein the motor drive means incorporates a drive connection between the motor drive means and the patient support platform, and further comprising actuation means (20, 21) for engaging and disengaging the drive connection.

4. A therapeutic bed as recited in claim 3 wherein the drive connection comprises a belt (15).

5. A therapeutic bed as recited in claim 3 wherein the motor drive means includes:

an electric motor (10) mounted on one of the main bed frames;

a gear box (10) connected to the output of the motor;

an output pulley (11) driven by the electric motor through the gear box; and a drive train, the drive train comprising:

the output pulley, an end board (13) connected to the patient support platform;

an arcuate belt engaging track (14) on the end board; and a drive belt (15) secured adjacent both ends of the track and engaging the output pulley intermediate its ends.

6. A therapeutic bed as recited in claim 5 wherein the actuation means comprises:

a belt engaging guide (18) disposed between one end of the arcuate belt engaging track and an end mounting (19) of the belt, and camming lever means (20, 21) for moving the guide to engage and disengage the belt from the track.

7. A therapeutic bed as recited in claim 1 wherein the bed includes a weighing means (61–67) for the patient support platform.

8. A therapeutic bed as recited in claim 7 wherein the weighing means is incorporated in pivotal mountings (4) of the patient support platform.

9. A therapeutic bed as recited in claim 8 wherein the weighing means comprises a load cell interposed between each pivotal mounting and the main bed frame.

10. A therapeutic bed as recited in claim 1 wherein control means (30) are provided to control the motor drive means to vary the arc of oscillation on either side of the vertical axis and over time.

11. A therapeutic bed as claimed in claim 10 in which a potentiometer (36) is coupled to the patient support platform and in which means (33–35) for applying a variable base control voltage to the potentiometer are provided, an electrical connection between the potentiometer and the motor control means being provided, the motor being stopped and its direction of motion being reversed when a desired voltage is applied to the potentiometer.

12. A method of controlling rotation of a patient support platform of a therapeutic bed including a generally horizontal, elongate base frame (5), a pair of end uprights (6) individually upstanding from opposite ends of the base frame, said uprights being individually height adjustable, crankshaft means pivotally connected to one end of the base frame for pivotal movement about a first pivot axis (8), at least one said end uprights being pivotally mounted to the crankshaft means for pivotal movement about a second pivot axis (7) laterally offset from said first pivot axis, a pair of main bed frames (3) individually mounted to said pair of uprights at opposite ends of the base frame, a generally horizontal, elongate patient support platform (2) pivotally mounted (4) at opposite ends thereof to and between said main bed frames, and motor drive means operatively coupled to said patient support platform for oscillating said platform relative to the main bed frame, wherein the motor drive means incorporates a drive connection between the motor drive means and the patient support platform, and further comprising actuation means (20, 21) for engaging and disengaging the drive connection, and wherein the motor drive means includes an electric motor (10) mounted on one of the main bed frames, a gear box (10) connected to the output of the motor, an output pulley (11) driven by the electric motor through the gear box, and a drive train, the drive train comprising the output pulley, an end board (13) connected to the patient support platform, an arcuate belt engaging track (14) on the end board, and a drive belt (15) secured adjacent both ends of the track and engaging the output pulley intermediate its ends, said method comprising the steps of:

sensing and recording the angular velocity of the patient support platform;

sensing and recording the angular velocity of the motor output pulley;

comparing the recorded values to obtain a measured velocity difference;

comparing said measured velocity difference with an acceptable pre-set velocity difference value, and causing the motor to reverse its direction of rotation if the measured velocity difference is greater than the pre-set velocity difference value and return the patient support platform to a horizontal position.

* * * * *